US006311696B1

(12) United States Patent
Dittrich et al.

(10) Patent No.: US 6,311,696 B1
(45) Date of Patent: Nov. 6, 2001

(54) SMOKING ARTICLES

(75) Inventors: David John Dittrich; Richard Thomas Fiebelkorn, both of Southampton (GB)

(73) Assignee: British-American Tobacco Company Limited, Middlesex (GB)

( * ) Notice: Subject to any disclaimer, the term of this patent is extended or adjusted under 35 U.S.C. 154(b) by 0 days.

(21) Appl. No.: 08/438,853

(22) Filed: May 11, 1995

Related U.S. Application Data

(63) Continuation of application No. 08/230,533, filed on Apr. 20, 1994, now abandoned, which is a continuation of application No. 07/885,174, filed on May 19, 1992, now abandoned.

(30) Foreign Application Priority Data

May 20, 1991 (GB) ..... 9110873

(51) Int. Cl.[7] ..... A24B 15/00
(52) U.S. Cl. ..... 131/331; 131/334; 131/345
(58) Field of Search ..... 131/331, 334, 131/340, 341, 345

(56) References Cited

U.S. PATENT DOCUMENTS 3,368,566 * 2/1968 Avedikian ..... 131/341 X
4,266,561 * 5/1981 Litzinger ..... 131/341
5,105,834 * 4/1992 Saintsing et al. ..... 131/341 X
5,161,549 * 11/1992 Rosario ..... 131/341 X

FOREIGN PATENT DOCUMENTS

2308302 * 1/1974 (DE) ..... 131/341
3200068 * 7/1983 (DE) ..... 131/341

* cited by examiner

*Primary Examiner*—Aaron J. Lewis
(74) *Attorney, Agent, or Firm*—Pitney, Hardin, Kipp & Szuch, LLP

(57) ABSTRACT

The invention relates to low delivery cigarettes, usually having a mainstream particulate matter delivery of about 9 mg or less. An embodiment has a rod of tobacco material and a filter element. The filter element is an alkali filter material section having a loading level of less than 12% by weight of the section. The characteristics of the cigarettes are arranged so that, when smoked, the alkaline filter material is exposed to an amount of smoke acceptable to achieve an increased perception of smoke impact.

26 Claims, 1 Drawing Sheet

SMOKING ARTICLES

This application is a continuation, of application Ser. No. 08/230,533 filed Apr. 20, 1994, now abandoned, which is a continuation of application 07/885,174 filed May 19, 1992, now abandoned.

BACKGROUND OF THE INVENTION

1. Field of the Invention

This invention relates to smoking articles, and in particular, but not exclusively, to cigarettes.

2. Brief Description of Related Art

At the present time in the tobacco industry there is interest in ultra low delivery smoking articles, ultra low delivery meaning ultra low particulate matter delivery from the mainstream smoke of the cigarette. Ultra low particulate matter delivery cigarettes are cigarettes yielding about 5 mg or less particulate matter in the mainstream smoke. One problem with such cigarettes is that the smoker feels that there is little impact from the mainstream smoke upon smoking. A further problem is that the smoker also finds the smoke has a very low flavour amplitude. This is particularly evident in cigarettes having a particulate matter delivery of 1–2 mg.

This invention has application to low delivery cigarettes by offering means to increase the perceived smoke impact of such products and also to improve the perceived flavour of such products.

This invention has application to cigarettes having a mainstream particulate matter delivery of about 9 mg or less.

SUMMARY OF THE INVENTION

The present invention provides a smoking article comprising a filter element and a rod of tobacco material wrapped in a wrapper, the filter element comprising an alkaline filter material section, characterised in that the loading level of alkaline filter material is less than 12% by weight of the alkaline filter material section, and the characteristics of the smoking article are arranged so that, when smoked, the alkaline filter material is exposed to an amount of smoke acceptable to achieve an increased perception of smoke impact.

Preferably the increased perception of smoke impact is achieved without a mainstream smoke alkaline off-taste.

Advantageously the nicotine free dry particulate matter (NFDPM) to nicotine ratio is decreased compared with control cigarettes having the same cigarette characteristics without the addition of alkaline filter material to the filter element.

DETAILED DESCRIPTION OF THE PREFERRED EMBODIMENTS OF THE INVENTION

Figure 1:
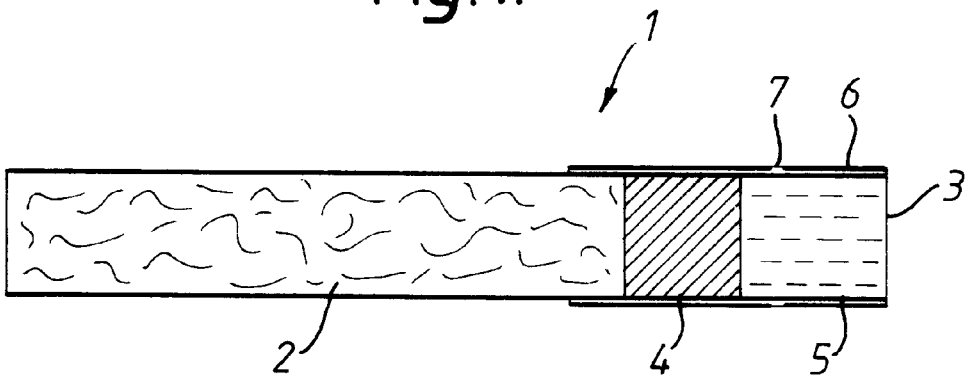
FIG. 1 shows a cigarette in cross-section according to the present invention comprising a dual filter element.

It is advantageous that the rod of tobacco material is a low particulate matter potential rod. As used herein the term "low particulate matter potential rod" means that, for a given length of tobacco material burnt, a lower amount of particulate matter is produced from such a rod than would be produced from a conventional rod of cut tobacco lamina and stem.

Preferably the low particulate matter potential of the rod of tobacco material is achieved by the presence of at least 30% expanded tobacco, the expanded tobacco having been subjected to a high filling power expansion process such as those described in U.S. Reissue Pat. No. 30,693 or U.K. 1 484 536. Preferably, the expanded tobacco is present in an amount of at least 40%, more preferably at least 50% and even more preferably at least 60%. Up to 100% expanded tobacco may be utilised depending on the degree of smoke delivery required.

In the alternative, the low particulate matter potential rod may suitably be comprised of a blend of lower nicotine grades of tobacco. However, a combination of low nicotine grade tobacco and a proportion of highly expanded tobacco may also suitably be utilised.

The loading level of the alkaline filter material may be less than 11%, and may be less than 9%, and may even be less than 7%. The loading level may further be less than 6% and may be in the region of about 4.5%. The loading level may also be as low as about 1–2%, depending on the particulate matter delivery of the rod of tobacco material and the degree of impact improvement required. For example, a loading level of 1–2% alkaline filter material may effectively be utilised to give an increased impact to the smoke delivery of a tobacco rod comprising 100% expanded tobacco.

The particulate matter delivery of the rod of tobacco material is suitably selected so as not to over-expose the alkaline filter section of the filter element to mainstream smoke.

Advantageously the tobacco filler material is provided with a water or moisture source. Preferably the moisture source comprises a high level of humectant, such as glycerol and/or propylene glycol, at a loading level of more than 2% by weight of the tobacco. The presence of a high level of humectant may be advantageous in terms of the diluent effect it has on the particulate matter delivery of the mainstream smoke. The moisture source may alternatively be provided by means of hydrated salts disposed on the tobacco filler material, which salts liberate water on heating as smoking occurs.

Preferably the alkaline filter material comprises a material which has a pH of about 7 to about 12 when in solution.

Preferably the alkaline filter material is one of sodium carbonate, potassium carbonate, sodium hydrogen carbonate, tri-sodium phosphate, magnesium hydroxide or other sodium, potassium or magnesium salts of strong bases and weak acids. Combinations of each of these materials may also be used.

Preferably the filter element is a dual filter element comprising a paper section and a cellulose acetate section. Suitably the alkaline filter material is applied to the paper section of the filter element as a solution.

Ventilation means may advantageously be provided in the filter element. Preferably in a dual filter element, such as described above, the ventilation occurs at the cellulose acetate section of the filter, which section is to be located at the mouth end of the filter element. Ventilation may be utilised to further control the amount of smoke delivered to the alkali-containing section of the filter element.

A multiple filter arrangement may also be suitable for the present invention. Such a multiple filter element is preferably comprised of a cellulose acetate section located at the mouth end of the filter element, an alkaline filter section and a further section located at the tobacco rod end comprised of cellulose acetate or paper. In such an arrangement it is preferable that the ventilation means is provided in the cellulose acetate section which is located at the mouth end of the filter. The cellulose acetate or paper section at the tobacco rod end is suitably of a high filtration efficiency.

In a further alternative triple filter arrangement the cellulose acetate section located at the mouth end of the filter may be replaced by a body of low filtration efficiency, high pressure drop material. A filter element particularly suitable is that supplied by Filtrona Limited under the designation "Ratio Filter" described in U.K. Patent Specification No. 2 118 423A. Such a filter element has a pressure drop of about 22 mm W.G./mm at a flow rate of 17.5 $cm^3 s^{-1}$ for a conventional diameter element. Ventilation means to provide ventilation to a level of at least 50% is suitably provided at the cellulose acetate section of the filter element.

The wrapper material of the rod may advantageously comprise a low sidestream wrapper, such as, for example, the wrapper described in our pending European Patent Application No. 0 404 580.

In order that the invention may be easily understood and readily carried into effect reference will now be made, by way of example, to the accompanying diagrammatic drawings.

In FIG. 1 there is depicted a cigarette 1 according to the present invention. The cigarette 1 is comprised of a rod 2 of tobacco material and a filter element 3. The filter element 3 has an alkaline filter section 4 comprising paper treated with an alkaline filter material, such as sodium carbonate, and a cellulose acetate section 5 at the mouth end of the cigarette. A tipping wrapper 6 has ventilation perforation holes 7. The ventilation holes 7 overlie the cellulose acetate section 5. The rod of tobacco material is comprised of a low particulate matter potential tobacco, such as is described below in Example 1.

Figure 2:
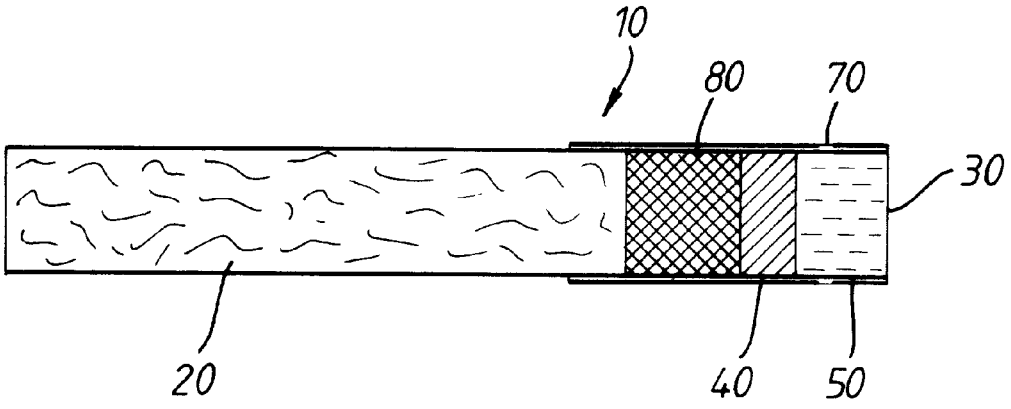
FIGS. 2 and 3 show cigarettes in cross-section according to the present invention, each cigarette comprising a different triple filter element.

In FIG. 2 there is depicted a cigarette 10 according to the present invention. A rod 20 of tobacco material lies adjacent to a triple filter section 30. The triple filter section 30 is comprised of a mouth end located cellulose acetate section 50, a central alkaline filter section 40 of paper treated with an alkaline filter material, such as potassium carbonate, and a rod end section 80. The rod end section 80 is a filter device sold under the trade name 'Ratio Filter' by Filtrona Limited. The Ratio Filter comprises a plug of high density polyethylene adjacent a plug of cellulose acetate. The cellulose acetate section of the Ratio Filter section is located to the rod end of the cigarette. Ventilation perforations 70 are provided in tipping wrapper 60. The perforations overlie the mouth end cellulose acetate section 50. Ventilation to a level of at least 70% is provided by means of the ventilation perforations 70. The amount of smoke offered to the alkaline filter section can thus be controlled, yet acceptable cigarette mechanics can still be maintained. Whilst a low particulate matter delivery rod is still desirable, the particulate matter potential of the rod of tobacco material may be higher than the particulate matter potential of the rods used in the embodiments described with respect to FIGS. 1 and 3.

Figure 3:
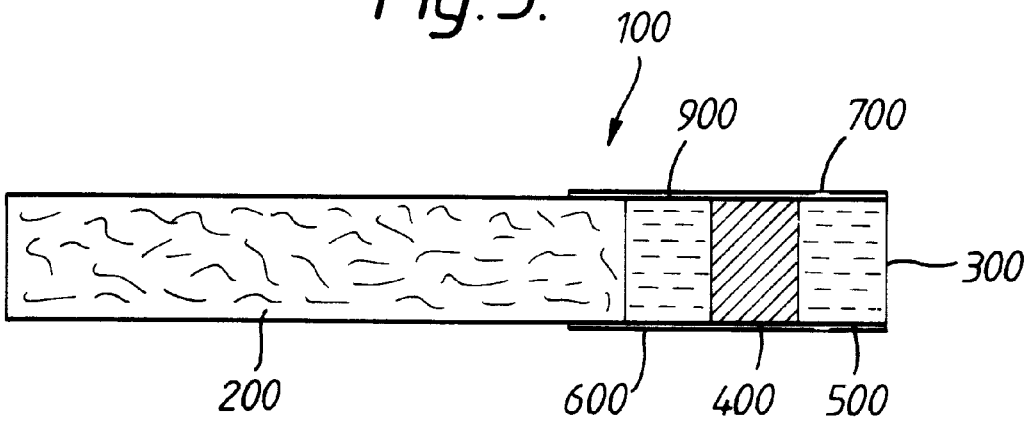

In FIG. 3 there is depicted a cigarette 100. The tobacco rod 200 thereof is comprised of a tobacco blend such as that described in Example 1 below. The filter element 300 is a multiple filter or triple filter arrangement. At the mouth end of the filter element 300 is a cellulose acetate section 500. At the rod end of the filter element 300 is a paper section 900 having a high filtration efficiency. Intermediate the cellulose acetate section 500 and the paper section 900 there is located an alkaline filter section 400 comprised of paper treated with sodium carbonate. A tipping wrapper 600 is provided with ventilation perforations 700. The degree of ventilation required is balanced with respect to the filtration efficiency of the paper section 900.

The following Examples were produced to a format such as is described in FIG. 1 above.

EXAMPLE 1

Cigarettes A and B according to the invention were produced having a tobacco rod length of 57 mm and a filter rod length of 27 mm. The filter rods were 27 mm long dual filter elements comprised of a 20 mm non-wrapped acetate (NWA) section having a pressure drop of 55 mm W.G. and a 7 mm paper section having a pressure drop of 33 mm W.G. The paper section was treated to provide sodium carbonate at a loading level of 5.8% wt/wt. The tobacco blend of the rod comprised 35% Burley tobacco, 50% flue-cured tobacco and 15% Oriental tobacco. This tobacco blend comprised 60% expanded tobacco. The extruded portion of the blend was treated with 6% glycerol and 2% honey.

The total tobacco blend was then treated with a further 2% propylene glycol.

Control cigarettes A' and B' were made having the same tobacco blend as the inventive cigarettes. The pressure drops of the filter elements were matched with those of the inventive cigarettes by the use of filter elements comprised of a 20 mm NWA section having a pressure drop of 57 mm W.G. and a 7 mm paper section having a pressure drop of 33 mm W.G. The filter elements of the inventive and control cigarettes were ventilated to a level of 55%.

The cigarettes were smoked under Coresta standard machine smoking conditions according to which a 35 $cm^3$ puff of two seconds duration is taken every minute. The results are given in the Table 1 below.

TABLE 1

| | NFDPM (mg/cig) | Nicotine (mg/cig) | NFDPM/Nicotine |
|---|---|---|---|
| A' | 4.23 | 0.50 | 8.5 |
| A | 3.91 | 0.48 | 8.1 |
| B' | 4.92 | 0.50 | 9.8 |
| B | 3.98 | 0.49 | 8.1 |

NFDPM = nicotine free dry particulate matter.

EXAMPLE 2

Cigarettes C and D according to the invention were made having a 25 mm filter element comprised of an 18 mm NWA section having a pressure drop of 51 mm W.G. and a 7 mm paper section having a pressure drop of 25 mm W.G. The paper section was treated to provide a sodium carbonate loading level of 10.4% wt/wt. Cigarettes C and D both comprised a blend of 35% Burley tobacco, 50% flue-cured tobacco and 15% Oriental tobacco. The expanded portion of the blend comprised 66% DIET tobacco for cigarettes C and 56% DIET tobacco for cigarettes D. The expanded portion of both tobacco blends were treated with 6% glycerol, 2% honey and 2% ammonium lactate. The total tobacco blend was then treated with a further 2% propylene glycol.

The filter elements for the control cigarettes C' and D' were 25 mm dual filter elements comprised of an 18 mm NWA section having a pressure drop of 57 mm W.G. and a 7 mm paper section having a pressure drop of 25 mm W.G., giving a substantially similar total pressure drop to that of the inventive cigarettes. The filter elements of control cigarettes C' and inventive cigarettes C had a ventilation level of 56%. The filter elements of Cigarettes D had a ventilation level of 55%. The ventilation level of Cigarettes D' was 56%. The tobacco blend for the control cigarettes was identical to that for the inventive cigarettes. The results on smoking are given in Table 2.

TABLE 2

| | NFDPM (mg/cig) | Nicotine (mg/cig) | NFDPM/Nicotine |
|---|---|---|---|
| C' | 5.25 | 0.64 | 8.2 |
| C | 5.17 | 0.80 | 6.5 |
| D' | 4.61 | 0.54 | 8.5 |
| D | 4.78 | 0.66 | 7.2 |

EXAMPLE 3

An even lower delivery cigarette, cigarettes E, according to the invention was made. The filter element was a 25 mm dual filter element as described in relation to the inventive cigarettes C and D. The ventilation level of Cigarettes E was 77%. The rod of tobacco material comprised 60% DIET expanded tobacco in a blend comprised of 10% Water treated stem, 25% Burley tobacco, 50% flue-cured tobacco and 15% Oriental tobacco. The expanded portion of the blend was treated with 2% glycerol, 2% honey and 1% ammonium lactate. The total tobacco blend was then further treated with 2% propylene glycol.

The control cigarette E' was produced with the same tobacco blend as inventive cigarette E and a dual filter element identical to the filter element used with control cigarettes C' and D'. The ventilation level of Cigarettes E' was 76%.

The results on smoking are given in Table 3.

TABLE 3

| | NFDPM (mg/cig) | Nicotine (mg/cig) | NFDPM/Nicotine |
|---|---|---|---|
| E' | 1.86 | 0.22 | 8.5 |
| E | 1.04 | 0.32 | 3.3 |

In all of the above Examples, the DIET tobacco had a propylene glycol loading level of about 4% after expansion. After blending, the whole blend was sprayed with a further 2% by weight of propylene glycol.

The Examples clearly show a decrease in the NFDPM to nicotine ratio.

It is particularly to be noted that the lowest delivery cigarette, cigarette E, shows the greatest decrease in the NFDPM to nicotine ratio.

Subjective evidence supports this quantitative data. In a blind paired comparison test between control and inventive cigarettes, the panel observed an increase in mouthfulness, flavour amplitude and impact for the inventive cigarettes. The inventive cigarettes had filter elements identical to the elements of inventive cigarettes C and D.

Comparison of these results with other panel tests on competitor brands of similar particulate matter delivery show an improved mouthfulness, flavour amplitude and impact for the inventive cigarettes over those brands.

As an indication of the absolute loading level of alkaline filter material suitable for the present invention, details of the filter sections and loading levels are given below:

Filter rods used in Example 1

| | |
|---|---|
| Weight of paper in paper section (unwrapped) = | 61.5 mg |
| Weight of sodium carbonate = | 3.6 mg |

Filter rods used in Example 2

| | |
|---|---|
| Weight of paper in paper section (unwrapped) = | 58.8 mg |
| Weight of sodium carbonate = | 6.1 mg |

The expanded tobacco portion of the tobacco blend of the above cigarettes was treated with ammonium lactate. Other suitable ammonium salts include ammonium malate and ammonium tartrate.

What is claimed is:

1. A smoking article comprising a filter element and a rod of tobacco material wrapped in a wrapper, said filter element comprising an alkaline filter material section, wherein said alkaline filter material section consists of alkaline filter material applied to a paper section of said filter element, the loading level of alkaline material being in the range of 1–12% by weight of said alkaline filter material section; said filter element further comprising a mouthend located section of cellulose acetate material; said rod of tobacco material being a rod of low particulate matter potential comprising at least 30% expanded tobacco, selected so as not to over expose said alkaline filter material section of said filter element to mainstream smoke, said mouthend located section of said filter element being provided with a ventilation level of at least 50% in order to further control the amount of smoke delivered to said alkaline filter material section, whereby the mainstream particulate matter delivery of said article is about 1 mg to about 9 mg when smoked under standard machine smoking conditions.

2. A smoking article comprising a filter element and a rod of tobacco material wrapped in a wrapper, said filter element comprising an alkaline filter material section, wherein said alkaline filter material section consists of alkaline filter material applied to a paper section of said filter element, the loading level of alkaline material being in the range of 1–12% by weight of said alkaline filter material section; said filter element further comprising a mouthend located section of cellulose acetate material; said rod of tobacco material being a rod of low particulate matter potential comprising low nicotine grade tobacco material, selected so as not to over expose said alkaline filter material section of said filter element to mainstream smoke, said mouthend located section of said filter element being provided with a ventilation level of at least 50% in order to further control the amount of smoke delivered to said alkaline filter material section, whereby the mainstream particulate matter delivery of said article is about 1 mg to about 9 mg when smoked under standard machine smoking conditions.

3. A smoking article comprising a filter element and a rod of tobacco material wrapped in a wrapper, said filter element comprising a triple filter element comprising an alkaline filter material section, wherein said alkaline filter material section consists of alkaline filter material applied to a paper section of said filter element, the loading level of alkaline material being in the range of 1–12% by weight of said alkaline filter material section; said filter element further comprising a mouthend located section of cellulose acetate material and a tobacco rod end located high filtration efficiency paper or cellulose acetate section; said rod of tobacco material being a rod of low particulate matter potential comprising at least 30% expanded tobacco, selected so as not to over expose said alkaline filter material section of said filter element to mainstream smoke, said mouthend located section of said filter element being ventilated, the degree of ventilation being balanced with respect to the filtration efficiency of the paper or cellulose acetate section located at the tobacco rod end of said filter element in order to further control the amount of smoke delivered to said alkaline filter material section; whereby the mainstream particulate matter delivery of said article is about 1 mg to about 9 mg when smoked under standard machine smoking conditions.

4. A smoking article comprising a filter element and a rod of tobacco material wrapped in a wrapper, said filter element comprising a triple filter element comprising an alkaline filter material section, wherein said alkaline filter material section consists of alkaline filter material applied to a paper section of said filter element, the loading level of alkaline material being in the range of 1–12% by weight of said alkaline filter material section, said filter element further comprising a mouthend located section of cellulose acetate material and a tobacco rod end located high filtration efficiency paper or cellulose acetate section; said rod of tobacco material being a rod of low particulate matter potential comprising low nicotine grade tobacco material, selected so as not to over expose said alkaline filter material section of said filter element to mainstream smoke, said mouthend located section of said filter element being ventilated, the degree of ventilation being balanced with respect to the filtration efficiency of the paper or cellulose acetate section located at the tobacco rod end of said filter element in order to further control the amount of smoke delivered to said alkaline filter material section; whereby the mainstream particulate matter delivery of said article is about 1 mg to about 9 mg when smoked under standard machine smoking conditions.

5. A smoking article comprising a filter element and a rod of tobacco material wrapped in a wrapper, said filter element comprising an alkaline filter material section, wherein said alkaline filter material section consists of alkaline filter material applied to a paper section of said filter element, the loading level of alkaline material being in the range of 1–12% by weight of said alkaline filter material section; said filter element further comprising a mouthend located section of cellulose acetate material; said rod of tobacco material being a rod of low particulate matter potential comprising at least 30% expanded tobacco, selected so as not to over expose said alkaline filter material section of said filter element to mainstream smoke, said mouthend located section of said filter element being provided with a ventilation level of at least 50% in order to further control the amount of smoke delivered to said alkaline filter material section.

6. A smoking article comprising a filter element and a rod of tobacco material wrapped in a wrapper, said filter element comprising an alkaline filter material section, wherein said alkaline filter material section consists of alkaline filter material applied to a paper section of said filter element, the loading level of alkaline material being in the range of 1–12% by weight of said alkaline filter material section; said filter element further comprising a mouthend located section of cellulose acetate material; said rod of tobacco material being a rod of low particulate matter potential comprising low nicotine grade tobacco material, selected so as not to over expose said alkaline filter material section of said filter element to mainstream smoke, said mouthend located section of said filter element being provided with a ventilation level of at least 50% in order to further control the amount of smoke delivered to said alkaline filter material section.

7. A smoking article comprising a filter element and a rod of tobacco material wrapped in a wrapper, said filter element comprising a triple filter element comprising an alkaline filter material section, wherein said alkaline filter material section consists of an alkaline filter material applied to a paper section of said filter element, the loading level of alkaline material being in the range of 1–12% by weight of said alkaline filter material section, said filter element further comprising a mouthend located section of cellulose acetate material and a tobacco rod end located high filtration efficiency paper or cellulose acetate section; said rod of tobacco material being a rod of low particulate matter potential comprising at least 30% expanded tobacco, selected so as not to over expose said alkaline filter material section of said filter element to mainstream smoke, said mouthend located section of said filter element being ventilated, the degree of ventilation being balanced with respect to the filtration efficiency of the paper or cellulose acetate section located at the tobacco rod end of the filter element in order to further control the amount of smoke delivered to said alkaline filter material section.

8. A smoking article comprising a filter element and a rod of tobacco material wrapped in a wrapper, said filter element comprising a triple filter element comprising an alkaline filter material section, wherein said alkaline filter material section consists of an alkaline filter material applied to a paper section of said filter element, the loading level of alkaline material being in the range of 1–12% by weight of said alkaline filter material section, said filter element further comprising a mouthend located section of cellulose acetate material and a tobacco rod end located high filtration efficiency paper or cellulose acetate section; said rod of tobacco material being a rod of low particulate matter potential comprising low nicotine grade tobacco material, selected so as not to over expose said alkaline filter material section of said filter element to mainstream smoke, said mouthend located section of said filter element being ventilated, the degree of ventilation being balanced with respect to the filtration efficiency of the paper or cellulose acetate section located at the tobacco rod end of the filter element in order to further control the amount of smoke delivered to said alkaline filter material section.

9. A smoking article comprising a filter element and a rod of tobacco material wrapped in a wrapper, said filter element comprising an alkaline filter material section, wherein said alkaline filter material section consists of alkaline filter material applied to a paper section of said filter element, the loading level of alkaline material being in the range of 1–12% by weight of said alkaline filter material section; said filter element further comprising a mouthend located section of cellulose acetate material; said rod of tobacco material being a rod of low particulate matter potential comprising at least 30% expanded tobacco, selected so as not to over expose said alkaline filter material section of said filter element to mainstream smoke, said mouthend located section of said filter element being provided with a ventilation level of at least 50% in order to further control the amount of smoke delivered to said alkaline filter material section, whereby the mainstream particulate matter delivery of said article is in the range of 1.04 mg to 5.25 mg when smoked under standard machine smoking conditions.

10. A smoking article comprising a filter element and a rod of tobacco material wrapped in a wrapper, said filter element comprising an alkaline filter material section, wherein said alkaline filter material section consists of alkaline filter material applied to a paper section of said filter element, the loading level of alkaline material being in the range of 1–12% by weight of said alkaline filter material section; said filter element further comprising a mouthend located section of cellulose acetate material; said rod of tobacco material being a rod of low particulate matter potential comprising low nicotine grade tobacco material, selected so as not to over expose said alkaline filter material section of said filter element to mainstream smoke, said mouthend located section of said filter element being provided with a ventilation level of at least 50% in order to further control the amount of smoke delivered to said alkaline filter material section, whereby the mainstream particulate matter delivery of said article is in the range of 1.04 mg to 5.25 mg when smoked under standard machine smoking conditions.

11. A smoking article comprising a filter element and a rod of tobacco material wrapped in a wrapper, said filter element comprising a triple filter element comprising an alkaline filter material section, wherein said alkaline filter material section consists of an alkaline filter material applied to a paper section of said filter element, the loading level of alkaline material being in the range of 1–12% by weight of said alkaline filter material section, said filter element further comprising a mouthend located section of cellulose acetate material and a tobacco rod end located high filtration efficiency paper or cellulose acetate section; said rod of tobacco material being a rod of low particulate matter potential comprising at least 30% expanded tobacco, selected so as not to over expose said alkaline filter material section of said filter element to mainstream smoke, said mouthend located section of said filter element being ventilated, the degree of ventilation being balanced with respect to the filtration efficiency of the paper or cellulose acetate section located at the tobacco rod end of the filter element in order to further control the amount of smoke delivered to said alkaline filter material section, whereby the mainstream particulate matter delivery of said article is in the range of 1.04 mg to 5.25 mg when smoked under standard machine smoking conditions.

12. A smoking article comprising a filter element and a rod of tobacco material wrapped in a wrapper, said filter element comprising a triple filter element comprising an alkaline filter material section, wherein said alkaline filter material section consists of an alkaline filter material applied to a paper section of said filter element, the loading level of alkaline material being in the range of 1–12% by weight of said alkaline filter material section, said filter element further comprising a mouthend located section of cellulose acetate material and a tobacco rod end located high filtration efficiency paper or cellulose acetate section; said rod of tobacco material being a rod of low particulate matter potential comprising low nicotine grade tobacco material, selected so as not to over expose said alkaline filter material section of said filter element to mainstream smoke, said mouthend located section of said filter element being ventilated, the degree of ventilation being balanced with respect to the filtration efficiency of the paper or cellulose acetate section located at the tobacco rod end of the filter element in order to further control the amount of smoke delivered to said alkaline filter material section, whereby the mainstream particulate matter delivery of said article is in the range of 1.04 mg to 5.25 mg when smoked under standard machine smoking conditions.

13. A smoking article according to claim 1, 2, 3, 4 or 5 to 12, wherein the loading level of the alkaline filter material is less than 9% by weight of the alkaline filter material section.

14. A smoking article according to claim 1, 2, 3, 4, or 5 to 12, wherein the loading level of the alkaline filter material is less than 7% by weight of the alkaline filter material section.

15. A smoking article according to claim 1, 2, 3, 4 or 5 to 12, wherein the loading level of alkaline filter material is less than 6% by weight of the alkaline filter material section.

16. A smoking article according to claims 1, 2, 3, 4 or 5 to 12, wherein the tobacco filler material is provided with a water or moisture source.

17. A smoking article according to claim 16, wherein the water or moisture source is a humectant at a loading level of more than 2% by weight of the tobacco.

18. A smoking article according to claims 1, 2, 3, 4 or 5 to 12, wherein the alkaline filter material is selected from the group consisting of sodium carbonate, potassium carbonate, sodium hydrogen carbonate, tri-sodium phosphate, and magnesium hydroxide.

19. A smoking article according to claims, 1, 2, 3, 4 or 5 to 12, wherein the alkaline filter material is selected from the group consisting of sodium or potassium and magnesium salts of strong bases and weak acids.

20. A smoking article according to claim 1, 2, 3, 4 or 5 to 12, wherein the loading level of alkaline material is within the range of from 1 percent to less than 11 percent by weight of the alkaline filter material section.

21. A smoking article according to claim 1, 3, 5, 7, 9 or 11 wherein the rod comprises at least 40% expanded tobacco.

22. A smoking article according to claim 1, 3, 5, 7, 9 or 11 wherein the rod comprises at least 50% expanded tobacco.

23. A smoking article according to claims 1, 2, 5, 6, 9 or 10, wherein the filter element is a triple filter element.

24. A smoking article according to claim 1, 2, 5, 6, 9 or 10, wherein said filter element is a triple filter element comprising a rod end located body of low filtration efficiency and pressure drop of the order of 22 mm WG/mm.

25. A smoking article according to claim 1, 3, 5, 7, 9 or 11, wherein the tobacco material comprises low nicotine grade tobacco material.

26. A smoking article according to claim 2, 4, 6, 8, 10, or 12 wherein the tobacco material comprises an amount of expanded tobacco.

* * * * *